US009108791B2

(12) United States Patent
Shirkey

(10) Patent No.: US 9,108,791 B2
(45) Date of Patent: Aug. 18, 2015

(54) MEMORABILIA STORAGE DEVICE

(71) Applicant: Sentimental Me, Inc., Park Ridge, IL (US)

(72) Inventor: Stephanie L. Shirkey, Downers Grove, IL (US)

(73) Assignee: Sentimental Me, Inc., Park Ridge, IL (US)

( * ) Notice: Subject to any disclaimer, the term of this patent is extended or adjusted under 35 U.S.C. 154(b) by 0 days.

(21) Appl. No.: 13/966,082

(22) Filed: Aug. 13, 2013

(65) Prior Publication Data

US 2014/0042043 A1 Feb. 13, 2014

Related U.S. Application Data

(60) Provisional application No. 61/682,529, filed on Aug. 13, 2012.

(51) Int. Cl.

| | |
|---|---|
| ***B65D 85/00*** | (2006.01) |
| ***B65D 25/10*** | (2006.01) |
| ***B65D 77/04*** | (2006.01) |
| ***B65D 5/46*** | (2006.01) |
| ***B65D 5/468*** | (2006.01) |

(52) U.S. Cl.

CPC ..... *B65D 85/70* (2013.01); *B65D 5/4604* (2013.01); *B65D 5/4608* (2013.01); *B65D 25/10* (2013.01); *B65D 77/042* (2013.01); *B65D 77/0453* (2013.01)

(58) Field of Classification Search

USPC ..... 206/575, 577, 499, 315.11, 373, 541; 220/23.88, 23.87, 23.9, 503

See application file for complete search history.

(56) References Cited

U.S. PATENT DOCUMENTS

| | | | | | |
|---|---|---|---|---|---|
| 1,644,830 | A | * | 10/1927 | Henderson | 312/209 |
| 1,900,820 | A | * | 3/1933 | Kenyon et al. | 206/576 |
| 2,743,836 | A | | 5/1956 | Roberts | |
| 2,851,188 | A | * | 9/1958 | Pavelle | 206/502 |
| 2,998,129 | A | * | 8/1961 | Bekins | 206/523 |
| 3,250,283 | A | | 5/1966 | Reinfeld | |
| 3,273,700 | A | * | 9/1966 | Moreau et al. | 206/1.7 |

(Continued)

FOREIGN PATENT DOCUMENTS

WO WO2011/026011 A2 3/2011

OTHER PUBLICATIONS

PCT, Notification of Transmittal of the International Search Report and the Written Opinion of the International Searching Authority, or the Declaration, in International Application No. PCT/US2013/054768, dated Jan. 10, 2014. (16 pages).

(Continued)

*Primary Examiner* — Jacob K Ackun

(74) *Attorney, Agent, or Firm* — McAndrews, Held & Malloy, Ltd.

(57) ABSTRACT

A memorabilia storage device for storing a plurality of items. The storage device may include a housing that has at least one sidewall that generally defines a cavity and a lid. The storage device may also include an sleeve that is configured for placement within the cavity. The sleeve is configured to receive a plurality of content holders. The plurality of content holders may have a variety of different shapes, sizes, and configurations so as to be capable of storing a variety of different types of memorabilia. Additionally, various different combinations of the different sized content holders may be stored in the storage device.

12 Claims, 12 Drawing Sheets

(56) References Cited

U.S. PATENT DOCUMENTS

| | | | | | |
|---|---|---|---|---|---|
| 4,139,096 | A | * | 2/1979 | Sieger | 206/315.11 |
| 4,163,559 | A | | 8/1979 | Stenstrom | |
| 4,616,748 | A | * | 10/1986 | Thomas et al. | 206/214 |
| 4,768,651 | A | * | 9/1988 | Lanius | 206/315.11 |
| 4,958,730 | A | * | 9/1990 | Bunten | 206/315.11 |
| 4,988,010 | A | * | 1/1991 | Pollak | 220/503 |
| 5,118,173 | A | * | 6/1992 | Proctor et al. | 312/213 |
| 5,267,647 | A | | 12/1993 | Stumpff et al. | |
| 5,295,577 | A | | 3/1994 | Minter | |
| 5,350,045 | A | | 9/1994 | Robertson | |
| 5,363,956 | A | | 11/1994 | Taniyama | |
| 5,366,069 | A | * | 11/1994 | Seidner | 206/84 |
| 5,381,903 | A | * | 1/1995 | Hardenne | 206/526 |
| 5,462,167 | A | | 10/1995 | Polinski et al. | |
| 5,495,940 | A | | 3/1996 | Taniyama | |
| 5,553,702 | A | | 9/1996 | Walsh | |
| 5,603,410 | A | | 2/1997 | Kara | |
| 5,611,124 | A | | 3/1997 | Biondo et al. | |
| 5,645,165 | A | | 7/1997 | Taniyama | |
| 5,712,005 | A | | 1/1998 | Moon | |
| 5,938,035 | A | * | 8/1999 | Oglesby et al. | 206/576 |
| 6,244,400 | B1 | | 6/2001 | Bowers | |
| 6,257,621 | B1 | | 7/2001 | Smith | |
| 6,401,484 | B2 | | 6/2002 | Gano, III | |
| 6,421,890 | B1 | | 7/2002 | Biggar | |
| D463,662 | S | | 10/2002 | Leiden et al. | |
| 6,494,336 | B1 | * | 12/2002 | Bylo | 220/23.88 |
| 6,612,454 | B1 | * | 9/2003 | Lin | 220/23.88 |
| 6,776,281 | B2 | | 8/2004 | Ovadia | |
| 6,808,074 | B1 | * | 10/2004 | Schwartz | 206/577 |
| 6,889,836 | B2 | | 5/2005 | Colloton | |
| 6,951,283 | B2 | * | 10/2005 | Savoie | 206/577 |
| 7,096,546 | B2 | | 8/2006 | Poirier | |
| 7,232,157 | B2 | | 6/2007 | Amaral | |
| 7,367,450 | B2 | | 5/2008 | Maglione | |
| D592,853 | S | | 5/2009 | Parker | |
| 7,562,423 | B2 | | 7/2009 | Pryd-Kakuk | |
| 7,703,635 | B2 | | 4/2010 | Smith | |
| 7,798,391 | B2 | | 9/2010 | Tibbles et al. | |
| 7,926,657 | B1 | | 4/2011 | Dougan | |
| 8,162,147 | B1 | | 4/2012 | Ting et al. | |
| 8,167,131 | B1 | | 5/2012 | Anderson | |
| 8,210,387 | B2 | | 7/2012 | Twig et al. | |
| 8,469,195 | B2 | * | 6/2013 | Gosselink et al. | 206/769 |
| 2001/0047945 | A1 | | 12/2001 | Scherer | |
| 2003/0230888 | A1 | | 12/2003 | Grummich | |
| 2004/0118650 | A1 | | 6/2004 | Houseberg | |
| 2005/0126058 | A1 | | 6/2005 | Rojdev et al. | |
| 2006/0207894 | A1 | | 9/2006 | Maglione | |
| 2007/0072162 | A1 | | 3/2007 | Honadel | |
| 2008/0000127 | A1 | | 1/2008 | Shimer | |
| 2008/0053925 | A1 | | 3/2008 | Scheithauer | |
| 2008/0110712 | A1 | | 5/2008 | Strong et al. | |
| 2009/0261096 | A1 | * | 10/2009 | Wagner | 220/23.88 |
| 2010/0038369 | A1 | * | 2/2010 | Rivas CaNas et al. | 220/592.26 |
| 2012/0097572 | A1 | | 4/2012 | Mannillo | |
| 2012/0187020 | A1 | | 7/2012 | Gosselink et al. | |
| 2012/0318792 | A1 | * | 12/2012 | Larson et al. | 220/23.88 |

OTHER PUBLICATIONS http://scraphappychelsey.blogspot.com/2008_10_01_archive.html, Scrap Happy Oct. 2008, May 29, 2012, pp. 1-34.

* cited by examiner

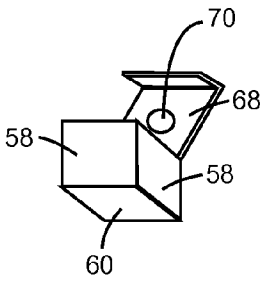
Figure 6b
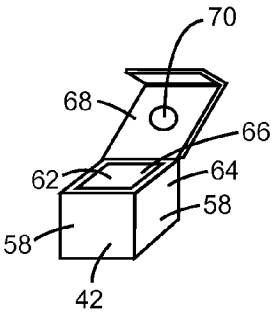
Figure 6a
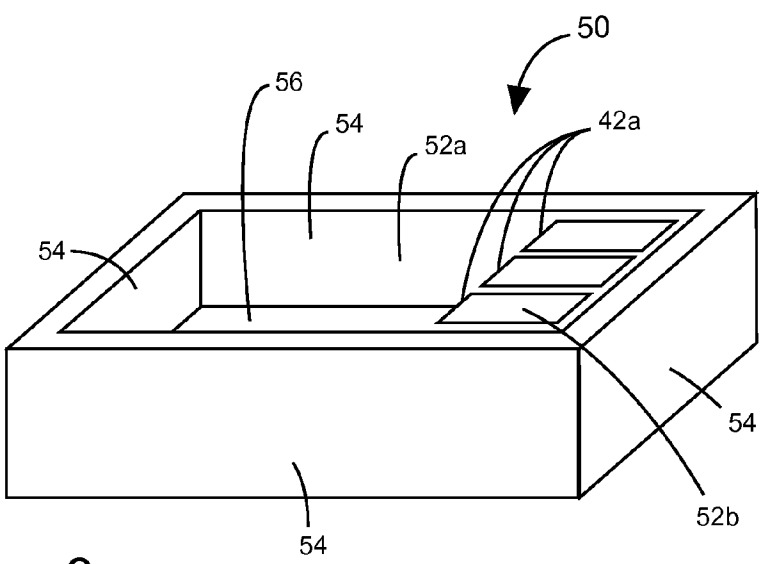
Figure 6c
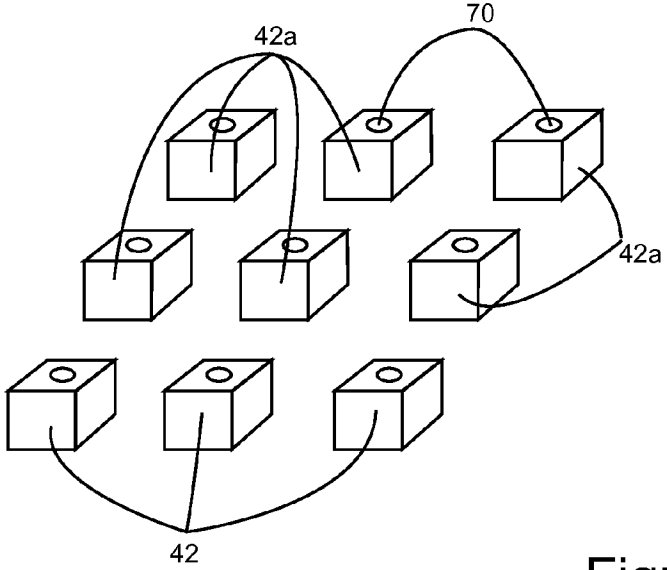

MEMORABILIA STORAGE DEVICE

RELATED APPLICATIONS

This application claims priority to U.S. patent application No. 61/682,529, having a filing date of Aug. 13, 2012, which is incorporated herein by reference in its entirety.

BACKGROUND OF THE INVENTION

Certain embodiments of the present technology relate to a storage device. More specifically, embodiments of the present technology relate to a modular storage device that may be used to house and/or protect various types of items, such as, for example, various types of memorabilia and/or collectables (collectively referred to herein as memorabilia).

Individuals may collect or retain various types of memorabilia, such as, for example, memorabilia related to items or events of interest, relative personal importance, and/or financial significance. For example, such memorabilia may relate to life events such as the birth of a child, a wedding, a vacation, a graduation or military service, or may relate to subjects of personal importance, such as a family pet. However, such memorabilia may come in a variety of different types, shapes, sizes, and forms. For example, memorabilia relating to the early years of an individual's life may include: documentation such as a birth certificate, preschool certificate, ticket stubs, and photograph album(s); physical items from the individual such as hair from a first haircut and baby teeth; and items worn by the individual, such as a child's first pair of shoes. Despite differences in the physical size of such memorabilia, in an effort to organize, prevent loss of an item(s), and/or protect such items from damage, among other considerations, a collector of such memorabilia may want to store related memorabilia together in a manner that protects the memorabilia from damage and/or prevents the loss of memorabilia. Further, the collector may wish to be able to accommodate subsequent increases in the size of the collection, including accommodating the inclusion of different types and/or sized memorabilia.

BRIEF SUMMARY OF THE INVENTION

Certain embodiments of the present technology provide a storage device for storing a plurality of items. The storage device includes a housing that has at least one sidewall that generally defines a cavity and an opening. The storage device further includes a lid that is configured to be seated on the housing, or sleeve enclosed therein, and to at least partially cover the opening of the housing when the storage device is in a closed condition. Additionally, the storage device includes a sleeve that is configured for placement within the cavity. The sleeve has at least one sidewall that generally defines an inner region of the sleeve. The storage device also includes a plurality of content holders that are positioned within the inner region of the sleeve. The plurality of content holders may each be configured to store one or more of the plurality of items in the inner area. Further, the plurality of content holders may include at least a first group of content holders and a second group of content holders. The content holders of the first group having a physical size that is different than a physical size of the content holders of the second group.

Additionally, certain embodiments of the present technology provide a storage device for storing a plurality of items, the storage device including a housing having at least one sidewall and a base. The at least one sidewall of the housing may generally define a cavity and an opening. The storage device also includes a sleeve which may be fixed, or configured for removable placement within the cavity. The sleeve includes at least one sidewall that generally defines an inner region of the sleeve. Additionally, the sleeve can include a discontinuity that is configured to provide an opening for access to the inner region of the sleeve when the sleeve is in an open condition. The storage device further includes a plurality of content holders that are arranged in a plurality of layers in the inner region of the sleeve. Each of the plurality of content holders includes an inner area configured to store one or more of the plurality of items.

BRIEF DESCRIPTION OF SEVERAL VIEWS OF THE DRAWINGS

FIGS. 6*a* and 6*b* illustrate front and bottom perspective views, respectively, of a content holder according to certain embodiments of the present invention.

FIG. 6*c* illustrates a perspective view of a tray and a plurality of content holders according to certain embodiments of the present invention.

Figure 1:
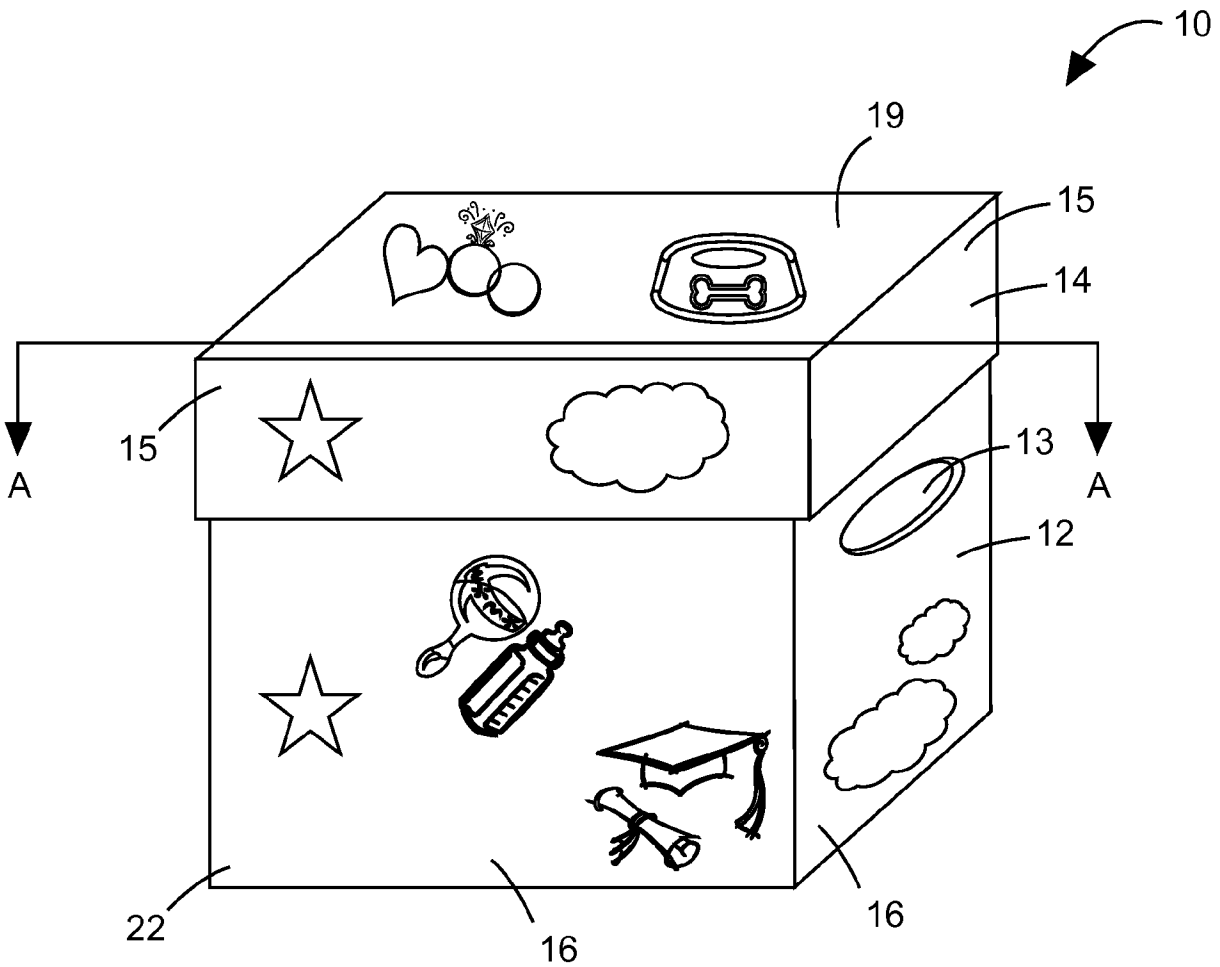
FIG. 1 illustrates a perspective front view of an assembled storage device in a closed condition according to certain embodiments of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

The following reference characters are used in the specification and figures:

| | |
|---|---|
| 10 | Storage device |
| 12 | Housing |
| 13 | Aperture |

-continued

| | |
|---|---|
| 14 | Cover |
| 15 | Sidewall (of cover 14) |
| 16 | Sidewall (of housing 12) |
| 17 | Interior region (of cover 14) |
| 18 | Cavity |
| 19 | Upper wall |
| 20 | Base |
| 22 | First end |
| 24 | Second end |
| 26 | Opening |
| 28 | Sleeve |
| 30 | Interior surface |
| 32 | Upper portion (of sleeve 28) |
| 34 | Opening (of sleeve 28) |
| 36 | Sidewall (of sleeve 28) |
| 38 | Inner region (of sleeve 28) |
| 40 | Base (of sleeve 28) |
| 41 | Base supports |
| 42 | Content holder |
| 44 | First layer |
| 46 | Second layer |
| 48 | Third layer |
| 50 | Tray |
| 52 | Storage compartment |
| 54 | Wall (of tray 50) |
| 56 | Bottom wall (of tray 50) |
| 58 | Sidewall (of content holder 42) |
| 60 | Base portion (of content holder 42) |
| 62 | Inner area (of content holder 42) |
| 64 | Upper region (of content holder 42) |
| 66 | Inlet |
| 68 | Lid |
| 70 | Aperture |
| 72 | Discontinuity |
| 74 | Fold |
| 80 | Handle |
| 82 | First portion |
| 84 | Second portion |
| 85 | Dashed Line |
| 86 | Outer Section (of first portion 82) |
| 87 | Inner cavity |
| 88 | Inner Section (of first portion 82) |
| 89 | Grip area |
| 90 | Flange (of first portion 82) |
| 92 | Inner Section (of second portion 84) |
| 94 | Flange (of second portion 84) |

DETAILED DESCRIPTION OF THE INVENTION

The present invention will now be described more fully with reference to the accompanying drawings, in which several embodiments are shown. This invention may, however, be embodied in many different forms and should not be construed as limited to the embodiments set forth here. Rather, these embodiments are examples of the invention, which has the full scope indicated by the language of the claims. Like numbers refer to like elements throughout.

Figure 2:
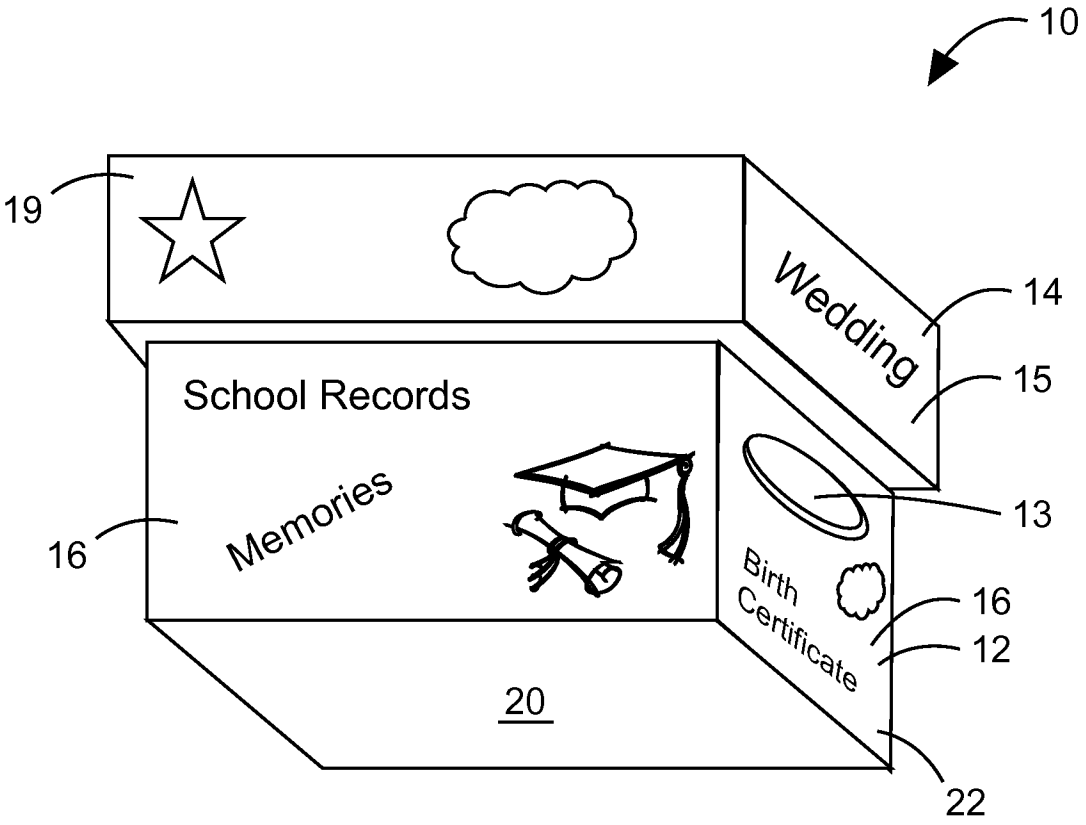
FIG. 2 illustrates a bottom perspective view of the assembled storage device illustrated in FIG. 1.

FIGS. 1 and 2 illustrate perspective views of an assembled storage device 10 in a closed condition according to certain embodiments of the present invention. According to certain embodiments, the storage device 10 may be constructed from a variety of different materials, including, for example, paper products such as cardboard, plastic, wood, and metal, among others. The storage device 10 includes a housing 12 and a cover 14. The housing 12 has at least one sidewall 16 that generally defines a cavity 18. The sidewall may have a variety of different configurations, including, for example, square, rectangular, trapezoidal, round, non-round, cylindrical, oval, star-shaped, triangular, and octagonal, among other shapes and/or configurations.

Figure 10:
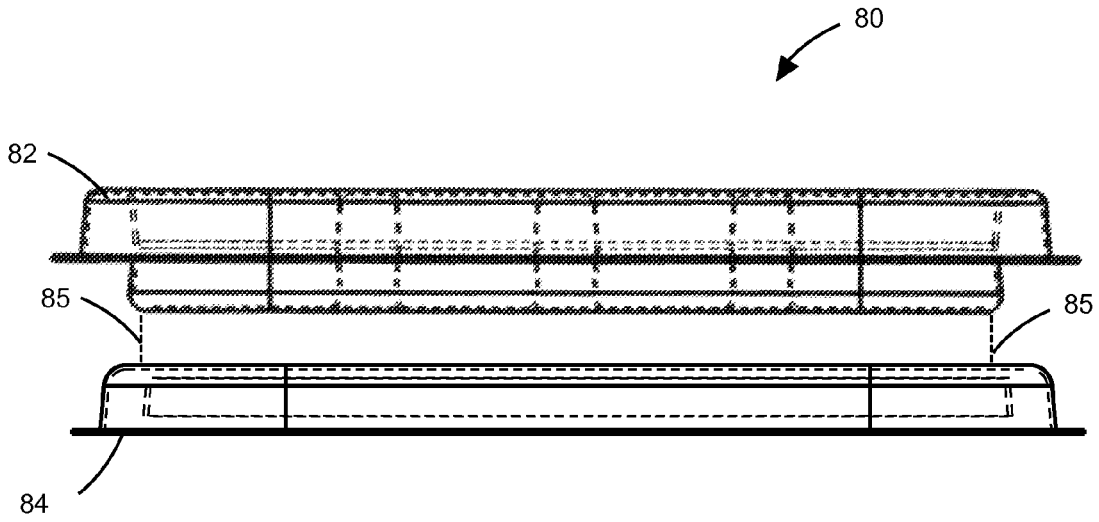
FIG. 10 illustrates a side view of a handle according to certain embodiments of the present invention.
Figure 11A:
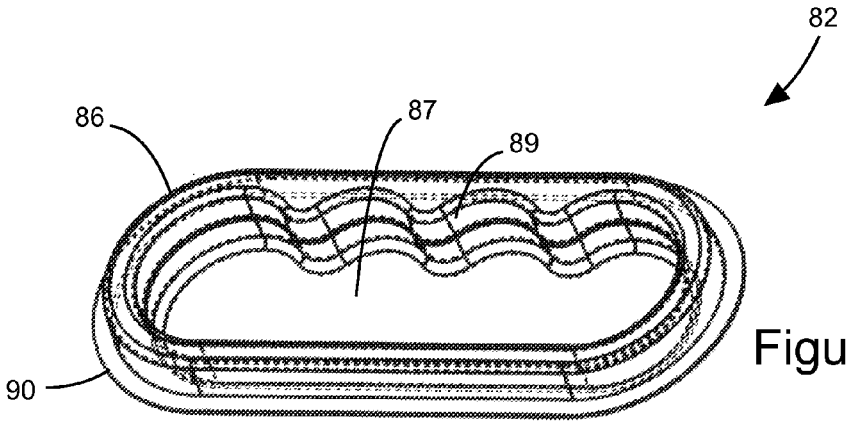
FIG. 11*a*, 11*b* and 11*c* illustrate front, and alternate side perspective views, respectively, of a first portion of a handle according to certain embodiments of the present invention.
Figure 11B:
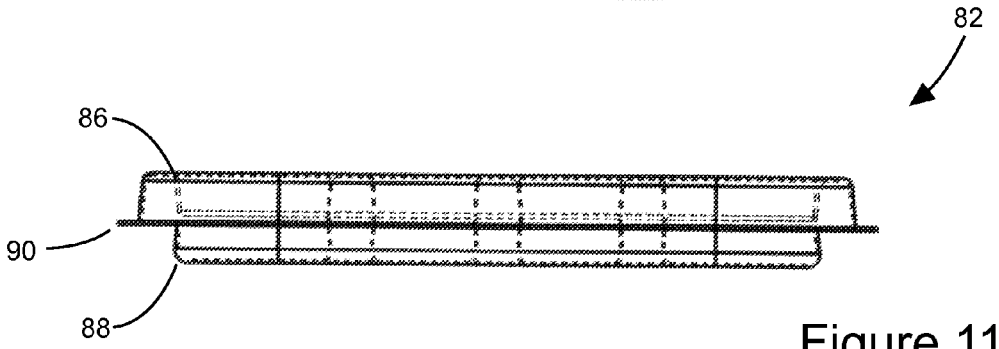
Figure 11C:
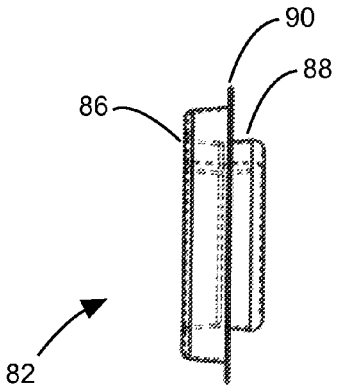
Figure 12A:
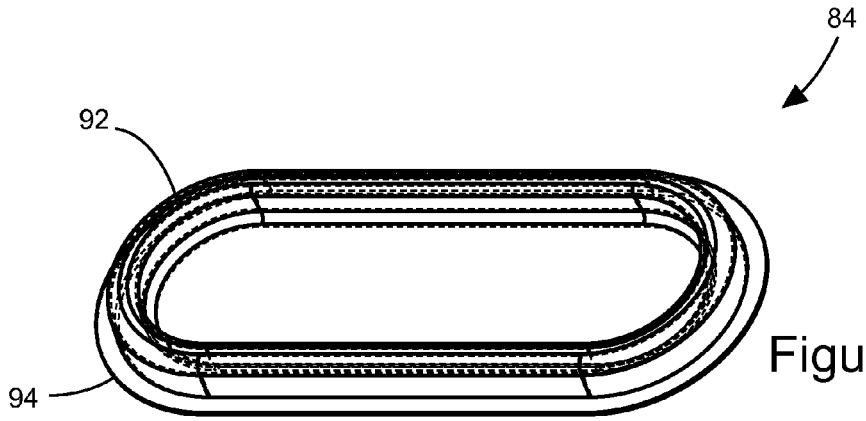
FIGS. 12*a*, 12*b* and 12*c* illustrate front, and alternate side perspective views, respectively, of a second portion of a handle according to certain embodiments of the present invention.
Figure 12B:
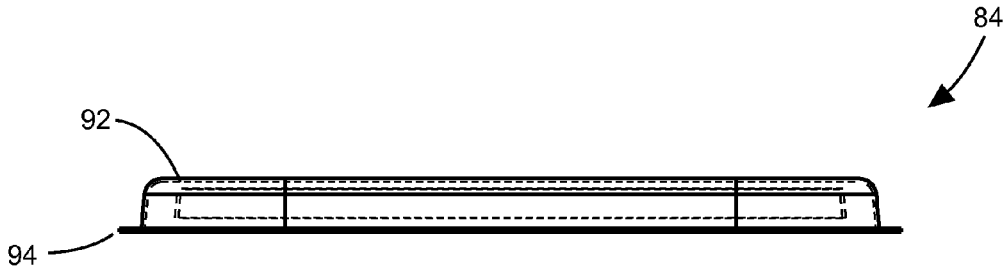
Figure 12C:
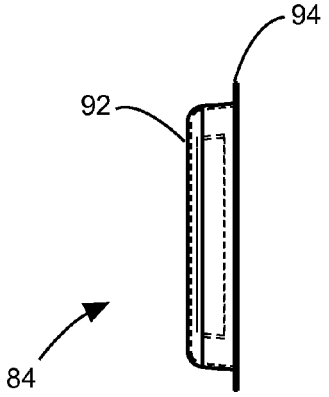

The housing 12 may include a base 20 that is positioned at a first end 22 of the sidewall 16. As shown in at least FIG. 3, a second end 24 of the sidewall 16 generally defines an opening 26 that is in communication with the cavity 18. Additionally, according to certain embodiments, the housing 12 may also include an aperture 13 that a user may engage when holding, lifting, and/or moving the housing 12. In addition, the housing 12 may be operably connected to a handle. A variety of different types of handles may be employed. For example, FIG. 10 illustrates a side view of a handle 80. According to certain embodiments, handle 80 can have a first portion 82 and a second portion 84. First portion 82 and second portion 84 can be operably connected together, such as, for example, along the path of dashed line 85 shown in FIG. 10. Moreover, accordingly to certain embodiments, the first portion 82 may include an outer section 86, an inner section 88, and a flange 90, as illustrated in FIGS. 11*a-c*. The outer section 86 may generally define an inner cavity 87, which may provide a grip area 89 that may be engaged by a user, such as, for example, for a user to hold, lift and/or move the housing 12. For example, the grip area 89 may include contoured surfaces or finger grips that facilitate gripping of the handle by the user. The second portion 84 may include an inner section 92 and a flange 94, as illustrated in FIGS. 12*a-c*. The first portion 82 and the second portion 84 may be sized for insertion into apertures 13, 33 of the housing 12 and or sleeve 28, respectively. In this fashion, the inner section 88 of the first portion 82, and the inner section 92 of the second portion 84 may be operably connected within apertures 13 and 33, and may provide additional structural integrity to housing 12 and/or sleeve 28. Additionally, the first portion 82 and the second portion 84 may be operably secured together, such as, for example, by an adhesive or mechanical fastener.

The cover 14 may include at least one sidewall 15 and an upper wall 19 that generally define an interior region 17 of the cover 14. At least a portion of the interior region 14 may be configured to allow the cover 14 to be seated on and/or over at least a portion of the housing 12, such as, for example, being seated against or adjacent to the second end 24 of the sidewall 16. Moreover, the cover 14 may be configured to, when the storage device 10 is in a closed condition, to cover the opening 26.

According to certain embodiments, the cover 14 may be unattached to the housing such that the cover may be removed and separated from the housing 12. However, according to other embodiments, the cover 14 may be attached to the housing 12, such as, for example, via a hinge, strap, or tether, among other connections.

Figure 3:
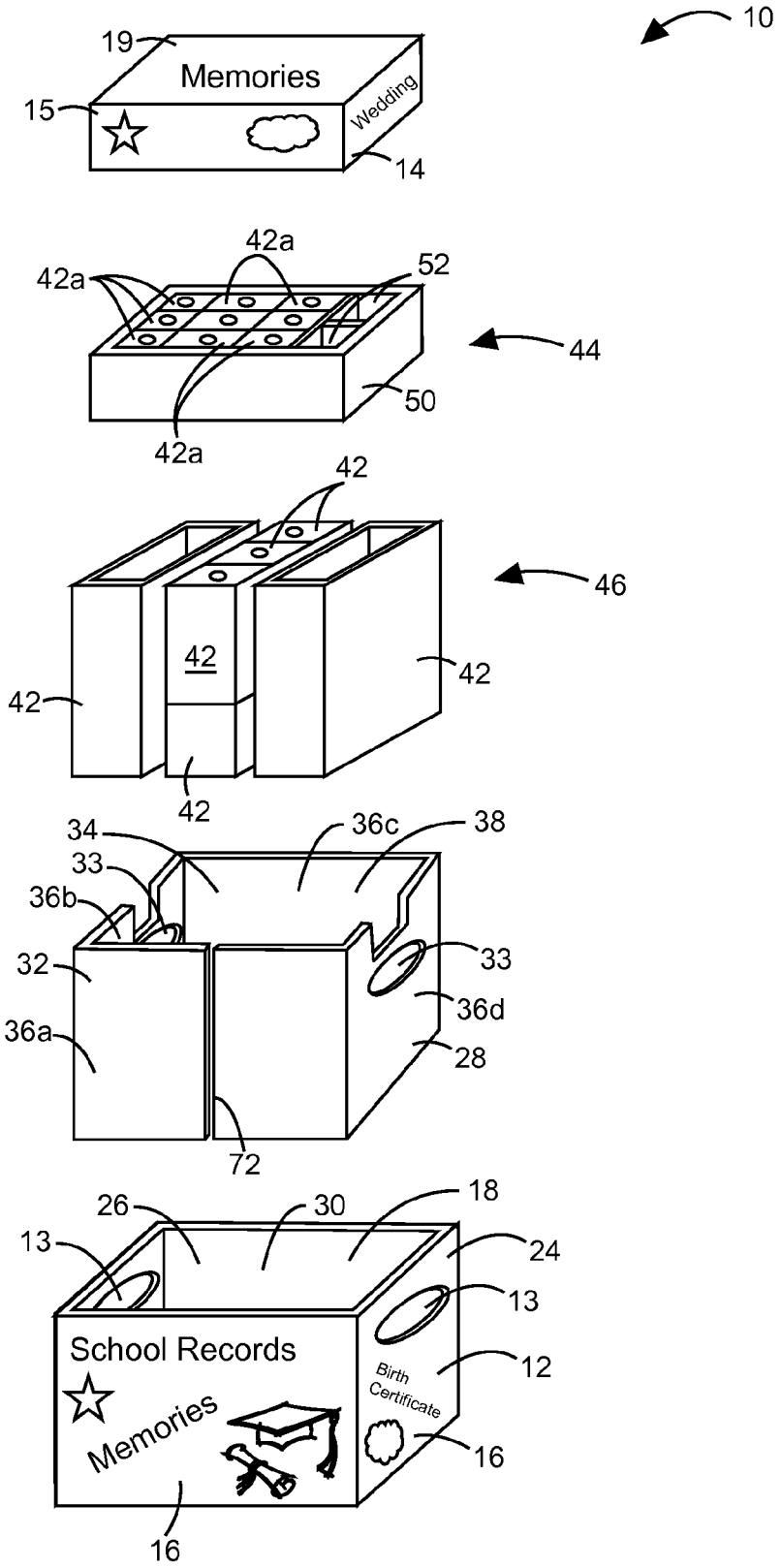
FIG. 3 illustrates an exploded view of an example of one arrangement of content holders in the storage device illustrated in FIG. 1.
Figure 4:
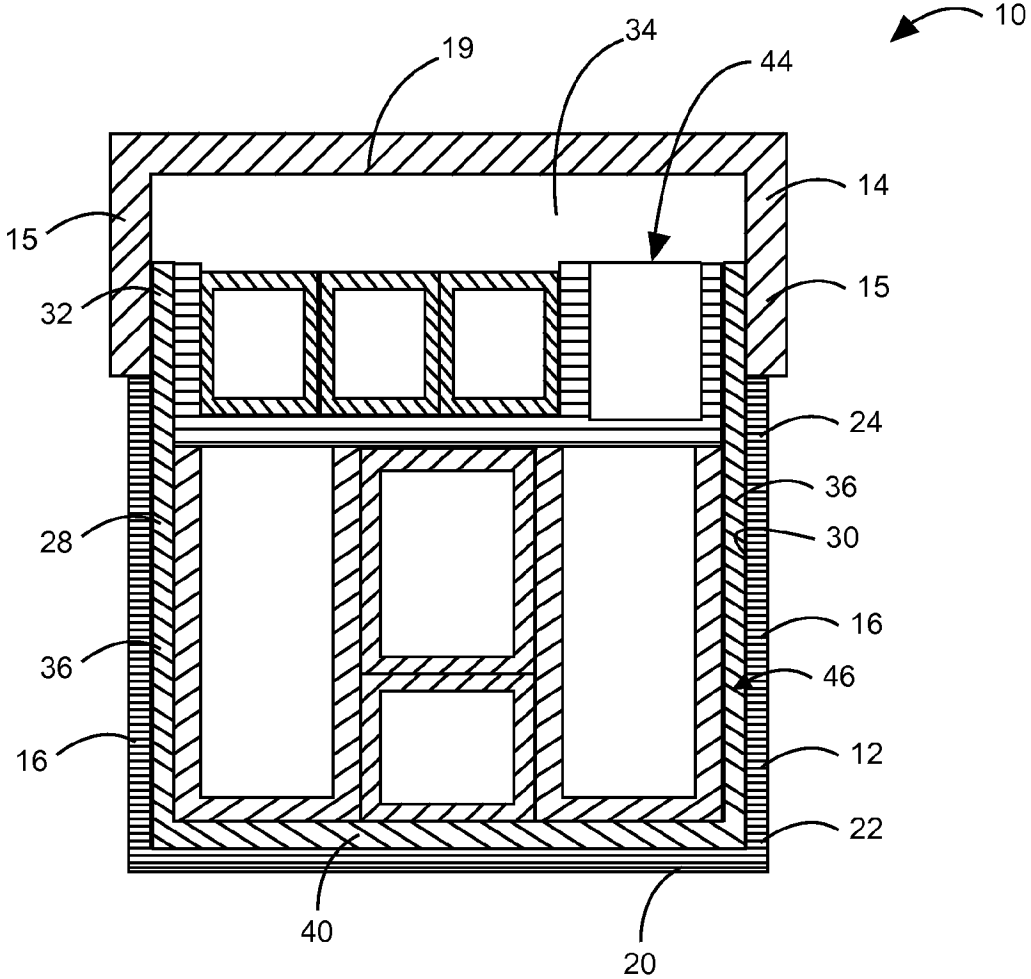
FIG. 4 illustrates a cross sectional view of a closed, assembled storage device from FIGS. 1 and 3 taken along line A-A in FIG. 1.
Figure 5:
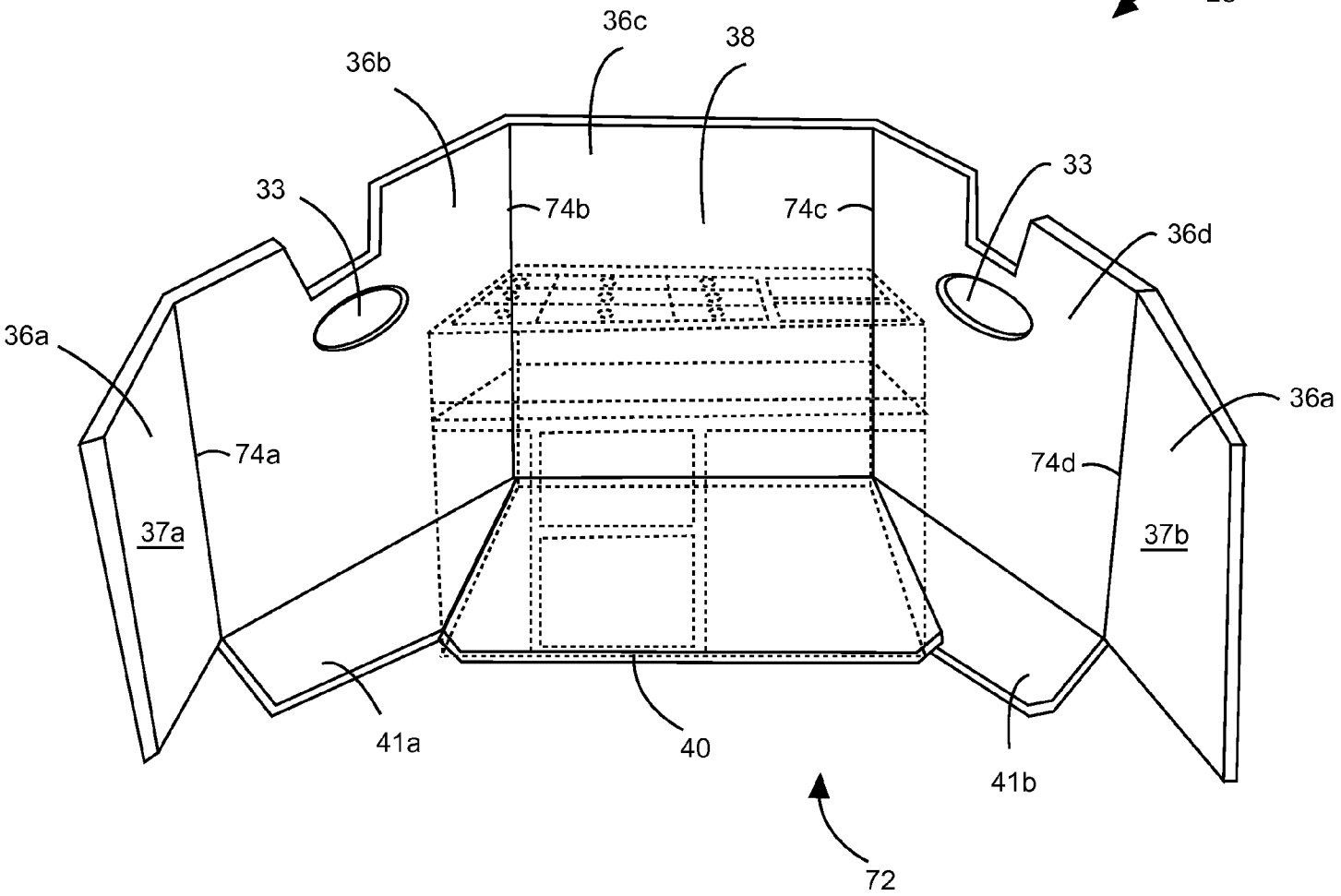
FIG. 5 illustrates an exemplary embodiment of a sleeve in an open condition according to certain embodiments of the present invention.

Referencing FIGS. 3-5, according to certain embodiments, the cavity 18 is configured to receive the insertion of a sleeve 28. For example, according to certain embodiments, the sleeve 28 may be configured to abut and/or otherwise be adjacent to at least a portion of the interior surface 30 of the sidewall 16 of the housing 12. The sleeve 28 may include at least one sidewall 36 and a base 40 that generally define an inner region 38 of the sleeve 28. Additionally, an upper portion of the at least one sidewall 36 opposite to the location of the base 40 may also generally define an opening 34 that is in communication with the inner region 38 of the sleeve 28. According to certain embodiments, the sleeve 28 may also include an aperture 33 that is generally aligned with the aperture 13 of the housing 12 when the sleeve 28 is properly positioned within the cavity 18 of the housing 12.

Additionally, according to certain embodiments, when the sleeve 28 is positioned within the housing 12, an upper portion 32 of the sleeve 28 may extend beyond the opening 26 of the housing 12. According to such embodiments, at least a portion of the upper portion 32 may be received in the interior region 17 of the cover 14. Further, interior region 17 may be sized to allow the cover 14 to be seated on the upper portion 32 of the sleeve 28 and/or to be seated about at least a portion of the second end 24 of the housing 12. Additionally, by extending the upper portion 32 of the sleeve 28, the upper portion 32 may provide an area of access for an individual to grab and/or hold the sleeve 28 so as to pull the sleeve 28 (and the contents contained or stored therein) away from, and out of, the housing 12.

The inner region 38 of the sleeve 28 may be configured to store one or more content holders 42. Moreover, as shown by at least FIGS. 3 and 9, the storage device 10, 10' may be configured to store one or more layers of content holders 42, such as, for example, first, second, and third layers 44, 46, 48. Further, the content holders 42 within the storage device 10 and/or along the one or more of the layers 44, 46, 48 may have a variety of different physical sizes, shapes, and/or configurations. Further, according to certain embodiments, the storage device 10 may include one or more trays 50 that are used to receive content holders 42, organize content holders 42, and/or provide one or more storage compartments 52 for items to be stored (with or without a content holder 42) in the storage device 10. According to certain embodiments, and as illustrated in FIG. 3, the content holders 42 and tray 50 may be arranged within the sleeve 28 to provide structural support to cover 14. Additionally, the content holders 42 and/or tray 50 may also be positioned within sleeve 28 in a manner that prevents or minimizes shifting movement of the content holders 42 about cavity 18.

FIGS. 6*a* and 6*b* illustrate perspective views of a content holder 42 according to certain embodiments of the present invention. The content holders 42 may have a variety of different shapes, sizes, and configurations. Further, the selection of sizes of the content holders 42 to be utilized in the storage device 10 may be based on a variety of different considerations, including, for example the type, physical size, durability, and/or condition of the item(s) that is/are to be stored in the content holder 42, the size, shape, and available space of/in the cavity 18 of the housing 12 and/or inner region 38 of the sleeve 28, and/or the number of content holders 42 to be stored in the device 10, among other considerations.

In the embodiment illustrated in FIGS. 6*a* and 6*b*, the content holder 42 may include a sidewall 58 and a base portion 60 that generally define an inner area 62 of the content holder 42. Additionally, an upper region 64 of the sidewall 58 may generally define an inlet 66 through which items may be placed into, or retrieved from, the inner area 62 of the content holder 42. The content holder 42 may or may not include a lid 68. The lid 68 may be moved between open and closed positions. When the lid 68 is in a closed position, the lid 68 generally covers at least a portion of the inlet 66. Access to the inlet 66 and inner area 62 of the content holder 42 may be provided when the lid 68 is in the open position, which may thereby allow items to be placed in/removed from the inner area 62. Additionally, according to certain embodiments, the lid 68 may include one or more apertures 70. The apertures 70 may be sized to receive a digit, such as a finger, of an individual or an instrument that may assist in displacing the lid 68 from the closed position to an open position.

Figure 9:
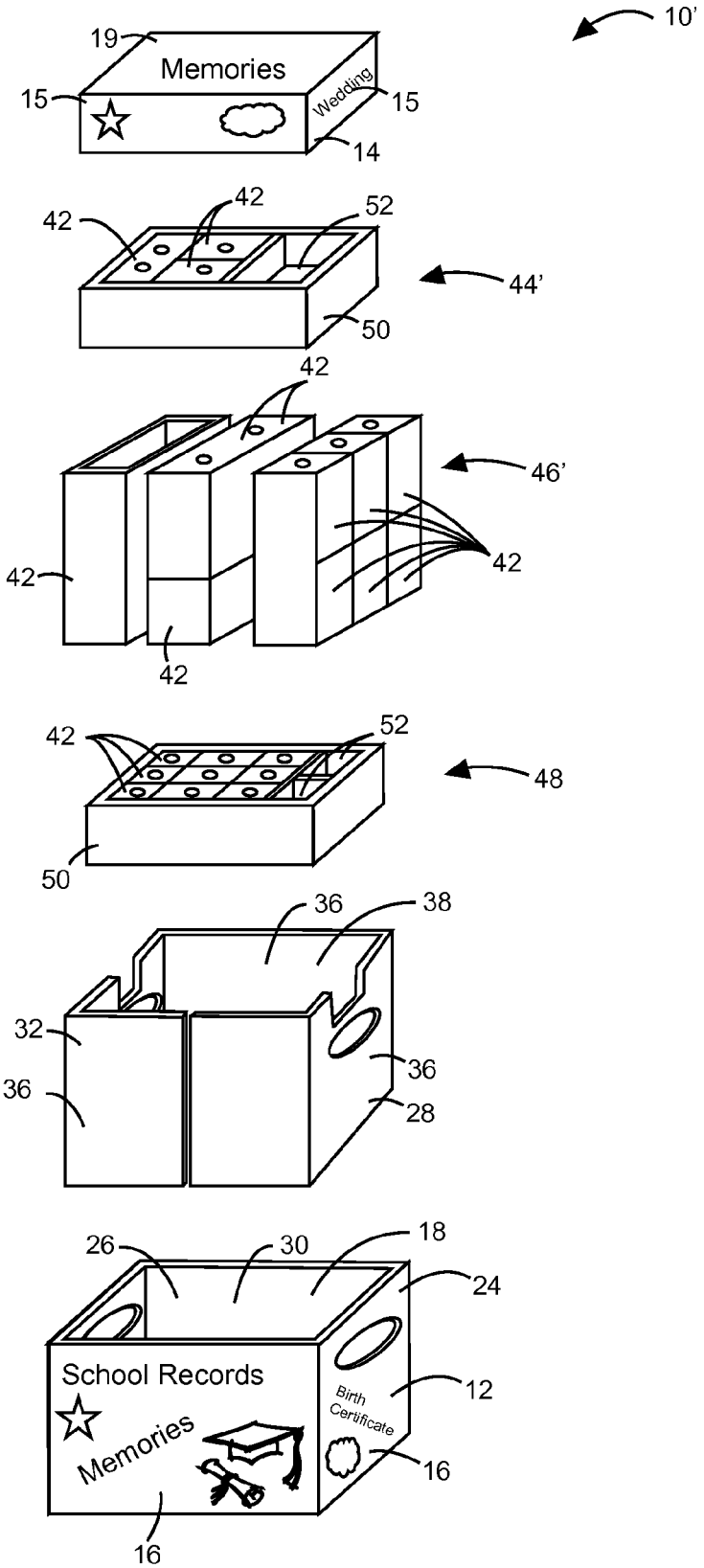
FIG. 9 illustrates an exploded view of an example of one arrangement of content holders in the storage device according to certain embodiments of the present invention.

FIG. 6*c* illustrates the content holders 42 and tray 50 as being part of the first layer 44 of the storage device 10 of FIG. 3, and as the third layer 48 of the storage device 10' in FIG. 9. As shown, the tray 50 includes one or more walls 54 and a bottom wall 56. According to certain embodiments, the walls 54 may define one or more storage compartments 52*a*. Additionally, one or more content holders 42 may be operably secured to the tray 50, such as, for example, by an adhesive. In the illustrated embodiment of FIG. 6*c*, content holders 42 are secured to the tray in an arrangement that provide storage compartments 52*a* and 52*b*. Content holders 42 may be sized to provide a variety of different shaped, sized, and number of storage compartments for the tray 50. Alternatively, the walls 54 of the tray 50 may define multiple storage compartments 52*a*, 52*b* and 52*c*, as shown, for example, in FIG. 7.

The one or more storage compartments 52 may be configured to receive items that are to be maintained in the storage device 10, such as, for example, documentation, and/or may receive content holders 42 that contain such items. For example, in the illustrated example, at least one storage compartment 52 is illustrated as being sized to relatively securely retain one or more content holders 42*a*.

In the example shown in FIG. 6*c*, the storage compartment 52 of the tray 50 may receive a single content holder 42 that has size similar to that of the storage compartment 52. Alternatively, the space provided by the storage compartment 52 may be generally occupied or filled by a plurality of content holders 42*a*, such as the nine relatively small, cubed-shaped content holders 42*a* illustrated at least in FIGS. 6*a* and 6*b*. For example, according to such embodiments, the nine content holders 42*a* shown in FIG. 6*c* and/or the storage compartment 52 may be sized such that these content holders 42*a* are relatively securely positioned in the storage compartment 52 in a manner that prevents or minimizes shifting movement of the content holders 42*a* about the storage compartment 52.

Figure 7:
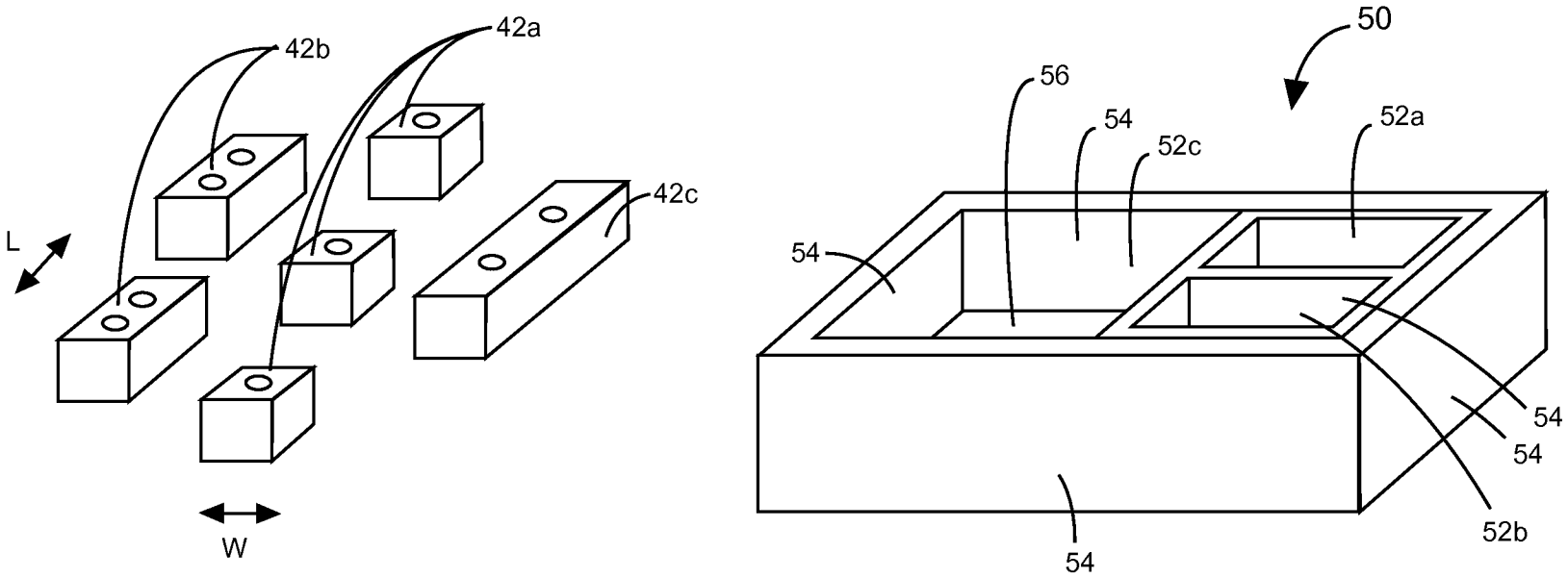
FIG. 7 illustrates a perspective view of a tray and a plurality of content holders according to certain embodiments of the present invention.

Alternatively, as shown at least by FIGS. 7 and the third layer 48 in FIG. 9, rather than utilizing similarly sized content holders 42*a*, a variety of different sized content holders 42*a*, 42*b*, 42*c* may be positioned in the storage compartment 52. According to such an embodiment, the selection of different sized content holders 42 may be based on whether the combined sized of the holders 42 will permit storage of the holders 42 in the selected storage compartment 52. For example, the content holders 42 may be selected and arranged to fit within the length ("L") and width ("W") constraints of the third compartment, as indicated in FIG. 7. In the present example, this may require aligning the two medium sized content holders 42*b*, the three small content holders 42*a*, and the single large content holder 42c in the manner similar to that indicated in FIG. 7.

Figure 8:
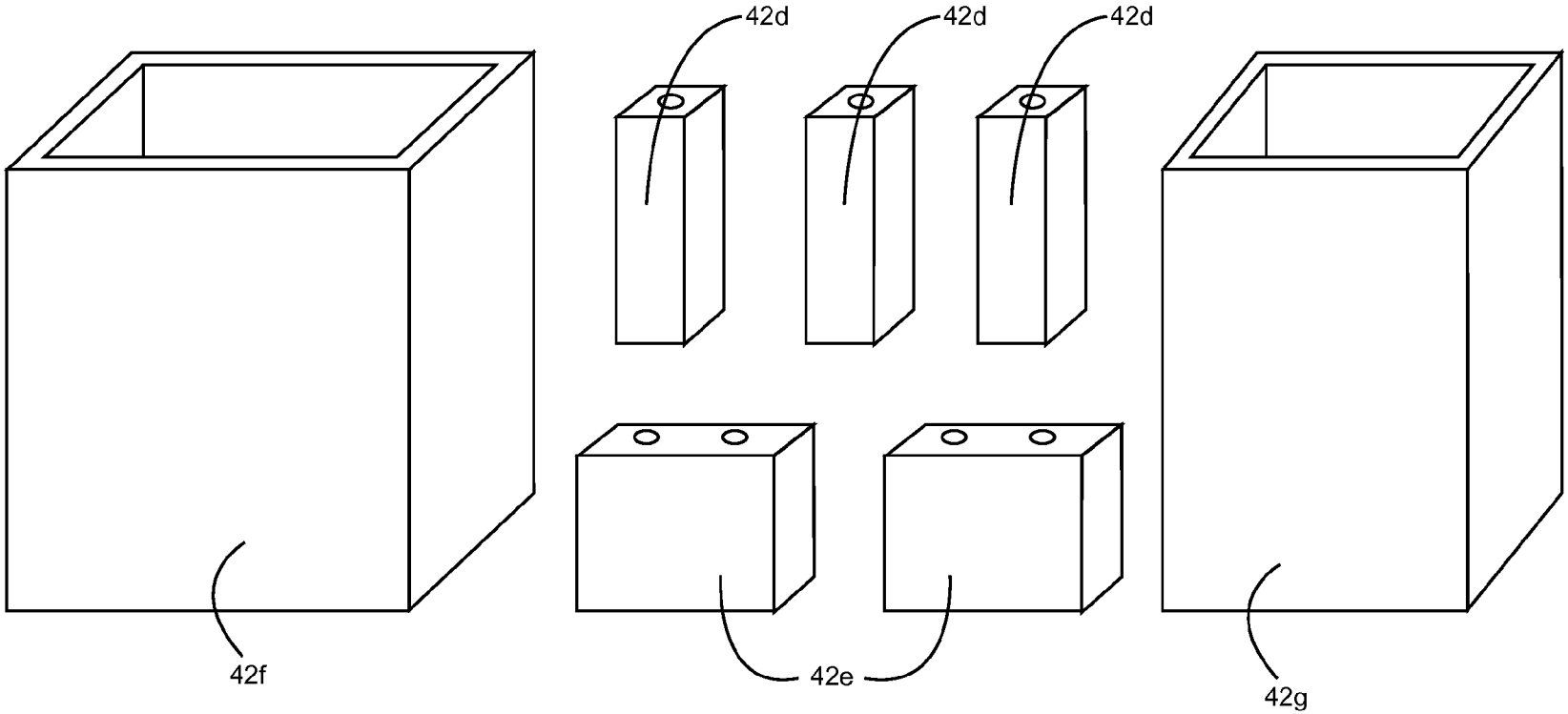
FIG. 8 illustrates a perspective view of a variety of different holders according to certain embodiments of the present invention.

However, content holders 42 may also be position within the storage device 10 and/or among a layer 44, 46, 48 without the use of a tray. For example, FIG. 8 illustrates the content holders 42 that are shown as being part of the second layer 46 in FIG. 3. As shown in this example, the second layer 46 may include first and second sized content holders 42*d*, 42*e* that are stacked together and that have lids 68. Additionally, this layer 46 may also include relatively taller third and fourth content holders 42*f*, 42g that have different widths and do not include lids 68. According to this example, at least upper surfaces of the third and fourth content holders 42*f*, 42*g*, and possibly the first content holders 42*d* may abut against bottom wall 56 of the tray 50.

While the foregoing examples have described and illustrated particular layers 44, 46, 48 with a variety of different sized and shaped content holders 42, the shape, size, configuration, and number of content holders 42 stored in the device 10 and/or in a layer 44, 46, 48 may depend on a variety of factors, including, for example, the type or size of the item being stored in the storage device 10 and the size of the housing 12 and/or sleeve 28, among other considerations. Further, the option of using different sized and/or shaped content holders 42 based on such considerations allows for the implementation of a modular storage system, as different combinations of types and sizes of content holders 42 in a variety of different arrangements and combinations may be stored in the device 10.

FIG. 5 illustrates an exemplary embodiment in which the sleeve 28. According to certain embodiments, the sleeve 28 may be secured within the cavity 18, such as, for example, by an adhesive that attaches the sleeve 28 to an inner portion of the sidewall 16 and/or the base 20. Alternatively, according to certain embodiments, the sleeve 28 may be configured to be removable from the housing 12 and opened to provide access to the content holders 42 stored therein. In this example, the general location of content holders 42 that may or will be positioned in, or have been removed from, the inner region 38 are indicated by phantom lines. According to such an embodiment, access to content holders 42 and/or the inner region 38 may be provided not only through the opening 34 of the sleeve 28, but also by opening or expanding the size of a discontinuity 72 in the sidewall 36, such as, for example, expanding the size of a gap, space, or separation between portions of the sidewall 36 or accessing or opening a window in the sidewall 36.

For example, according to certain embodiments, the sleeve 28 may be single piece of material, such as, for example, cardboard, that is folded to form four sidewalls 36a-d, a base 40, and base supports 41*a*, 41*b*. Further, the first sidewall 36a may include first and second wall portions 37*a*, 37*b* that are at least partially separated from each other by the discontinuity 72. Moreover, in this example, the discontinuity 72 may be the location wherein two opposing sides of the material used to construct the sleeve 28 meet or are adjacent to each other when the sleeve 28 is assembled other otherwise folded to be in a closed condition, as shown in FIG. 3.

In the illustrated embodiment, when the sleeve 28 is out of the housing 12 and the interior region 38 of the sleeve 28 is to be accessed, at least the fold 74*a* between the first portion 37*a* of the first sidewall 36*a* the second sidewall 36*b* may provide a pivot location that allows the first portion 37*a* to be pivotally displaced from a closed position, as shown in FIG. 3, toward an open position, such as, for example, as shown in FIG. 5. Similarly, at least the fold 74*d* between the second portion 37*b* of the first sidewall 36*a* the fourth sidewall 36*d* may provide a pivot location that allows the second portion 37*b* to be moved from a closed position, as shown in FIG. 3, toward the open position. Further, the folds 74*b*, 74*c* between the second and third sidewalls 36*b*, 36*c* and third and fourth sidewalls 36*c*, 36*d*, respectively, may also provide pivot points for pivotally displacing at least the second and fourth walls 36*b*, 36*d* to further increase the size of the discontinuity 72, and more specifically, in this example, to increase the distance between the first and second portions 37*a*, 37*b* of the first sidewall 36*a*. When the sleeve 28 is to be returned from an open condition to the closed condition, the folds 74*a-d* may again be used for pivotally displacing at least a portion of the walls 36*a*, 36*b*, 36*d* back to closed positions.

The invention claimed is:

1. A storage device for storing a plurality of items, the storage device comprising:

a housing having four sidewalls and a base that generally define a cavity and an opening;

a lid configured to be seated on the housing and to at least partially cover the opening of the housing when the storage device is in a closed condition;

a sleeve configured for placement within the cavity, the sleeve having four sidewalls that generally define a length, a width and an inner region of the sleeve;

a plurality of content holders positioned within the inner region of the sleeve to form a first layer substantially equivalent to the length and width of the sleeve, the plurality of content holders each having four distinct sidewalls and a base and configured to store one or more of the plurality of items, wherein the plurality of content holders include a first group of content holders and a second group of content holders, the content holders of the first group having a physical size that is different than a physical size of the content holders of the second group, and wherein one or more of the content holders include a lid; and a tray having a plurality of storage compartments, the tray being configured to be positioned within the inner region of the sleeve to form a second layer substantially equivalent to the length and width of the sleeve positioned wholly above the first layer formed by content holders.

2. The storage device of claim 1, wherein the sleeve includes an upper portion that extends beyond the at least one sidewall of the housing when the sleeve is positioned within the cavity.

3. The storage device of claim 1, wherein the lid of the one or more of the content holders is configured to be moved from a closed position to an open position to provide an individual access to an inner area.

4. The storage device of claim 3, wherein the lid of the one or more of the content holders includes one or more apertures that are sized to receive a digit.

5. The storage device of claim 4, wherein one or more of the content holders do not include a lid.

6. The storage device of claim 1, wherein at least one of the plurality of storage compartments is configured to receive at least one of the plurality of content holders.

7. The storage device of claim 2, wherein the sleeve is configured to be removable from the cavity, and wherein at least one sidewall of the sleeve includes a discontinuity, the discontinuity providing an opening for access to the inner region of the sleeve when the sleeve is in an open condition.

8. The storage device of claim 7, wherein at least one sidewall of the sleeve includes a first sidewall, the first sidewall having a first portion and a second portion, and wherein the discontinuity separates the first portion from the second portion when the sleeve is in a closed condition.

9. The storage device of claim 8, wherein a size of the discontinuity separating the first portion from the second portion increases as the sleeve changes from the closed condition to the open condition.

10. The storage device of claim 1, wherein at least two opposing sidewalls of the housing and at least two opposing sidewalls of the sleeve include apertures that a user may engage to move the storage device, the apertures configured to be aligned when the sleeve is positioned within the cavity.

11. The storage device of claim 10, wherein a handle is placed in the apertures so as to provide additional structural integrity to the storage device.

12. The storage device of claim 1, wherein the plurality of content holders are arranged so as to substantially eliminate lateral movement.

* * * * *